US008154265B2

(12) United States Patent
Napravnik

(10) Patent No.: US 8,154,265 B2
(45) Date of Patent: Apr. 10, 2012

(54) ENHANCED EFFICIENCY LOW-DROPOUT LINEAR REGULATOR AND CORRESPONDING METHOD

(75) Inventor: Karel Napravnik, Prague (CZ)

(73) Assignee: STMicroelectronics Design and Application S.R.O., Praha (CZ)

( * ) Notice: Subject to any disclaimer, the term of this patent is extended or adjusted under 35 U.S.C. 154(b) by 289 days.

(21) Appl. No.: 12/621,181

(22) Filed: Nov. 18, 2009

(65) Prior Publication Data

US 2010/0148735 A1 Jun. 17, 2010

(30) Foreign Application Priority Data

Dec. 15, 2008 (IT) ..... TO2008A0933

(51) Int. Cl.
*G05F 1/40* (2006.01)

(52) U.S. Cl. ..... 323/280; 323/274

(58) Field of Classification Search ..... 323/273–277, 323/280, 312–317
See application file for complete search history.

(56) References Cited

U.S. PATENT DOCUMENTS 6,246,221 B1 6/2001 Xi
7,106,033 B1 * 9/2006 Liu et al. ..... 323/280
7,710,091 B2 * 5/2010 Huang ..... 323/280
2004/0046532 A1 3/2004 Menegoli
2004/0140845 A1 * 7/2004 Eberlein ..... 327/541
2005/0040807 A1 2/2005 Chen
2007/0188228 A1 8/2007 Renous
2007/0241731 A1 10/2007 Van Ettinger
2010/0148736 A1 * 6/2010 Napravnik ..... 323/280

OTHER PUBLICATIONS

Italian Patent Office Written Opinion; Italy Application No. TO20080933, 7 pages, Jun. 2, 2009.

* cited by examiner

*Primary Examiner* — Jessica Han
(74) *Attorney, Agent, or Firm* — Hogan Lovells US LLP

(57) ABSTRACT

A low-dropout linear regulator includes an error amplifier which includes a cascaded arrangement of a differential amplifier and a gain stage. The gain stage includes a transistor driven by the differential amplifier to produce at a drive signal for an output stage of the regulator. The transistor is interposed over its source-drain line between a first resistive load included in a RC network creating a zero in the open loop gain of the regulator, and a second resistive load to produce a drive signal for the output stage of the regulator. The second resistive load is a non-linear compensation element to render current consumption linearly proportional to the load current to the regulator. The first resistive load is a non-linear element causing the frequency of said zero created by the RC network to decrease as the load current of the regulator decreases.

13 Claims, 5 Drawing Sheets

ENHANCED EFFICIENCY LOW-DROPOUT LINEAR REGULATOR AND CORRESPONDING METHOD

RELATED APPLICATION

This application claims priority of Italian Patent Application No. TO2008A000933 filed Dec. 15, 2008, which is incorporated herein in its entirety by this reference.

FIELD OF THE INVENTION

This disclosure relates to low-dropout linear regulators (LDOs). LDOs are used in a wide variety of applications in electronics to apply to a load a signal regulated as a function of a reference signal.

DESCRIPTION OF THE RELATED ART

The diagram of FIG. 1 is exemplary of the circuit layout of a conventional low-dropout linear regulator. The LDO of FIG. 1 is essentially comprised of a cascaded arrangement of an error amplifier 100 (in turn including a differential amplifier 102 receiving the reference signal VREF followed by a gain stage 104) and an output stage 106. The output stage 106 includes a Power MOS which receives from the gain stage 104 a voltage VGATE at its gate and applies an output voltage VOUT to a load including a resistive component Rload and a capacitive component Cload.

In the embodiment illustrated in FIG. 1, the gain stage 104 which constitutes the output stage of the error amplifier 100 includes a MOSFET M1. The drain of the MOSFET M1 is connected to the supply voltage VBAT via a resistor R2 and provides the signal VGATE to the Power MOS of the output stage 106. The source of the MOSFET M1 is connected to ground via a RC network including the parallel connection of a resistor R1 and a capacitor C1.

FIGS. 2 and 3 illustrate other conventional embodiments of the same stage 104.

Whatever the specific embodiment considered, those stages drive a non-linear power MOS (i.e. the LDO pass transistor M1) through a linear element (i.e. the resistor R2).

As a result, current consumption is not linearly proportional to the output current of LDO. A typical current consumption versus load current profile of an LDO is shown in FIG. 4.

This consumption profile causes lower efficiency at medium loads; however, the LDO stability is almost unaffected by any variations in the load current.

The inventor has noted that the various embodiments of the gain stage 104 illustrated in FIGS. 1 to 3 can be modified to obtain a linear current consumption profile by replacing the resistor R2 by means of a transistor connected as a diode.

This diode constitutes a non-linear element able to compensate the non-linearity of output power MOS in that a linear current mirror is created.

By adopting this approach, current consumption is made exactly linearly proportional to the load current.

The inventor has however noted that the output impedance of the transistor/diode constituting the non-linear compensation element increases for lower currents (so that the second pole of the open loop gain of the LDO is displaced towards lower frequencies) while the positive zero in the open loop gain of the LDO as created by the RC network associated with the source of M1 (i.e., R1 and C1) remains at a constant frequency.

The phase margin at middle frequencies is thus decreased and stability of the LDO is now adversely affected by load current variation.

SUMMARY OF THE INVENTION

The object of the invention is to provide an LDO arrangement having a higher efficiency with current consumption made linearly proportional to the load current while avoiding that stability is adversely affected. The preferred embodiment provides a solution to the stability problem within the framework of an arrangement which lends itself to an effective implementation. In this regard, the claims are an integral part of the disclosure of the invention provided herein.

In preferred embodiments, a new high-efficiency low-dropout regulator (LDO) is provided wherein efficiency is improved by applying strong linear current consumption dependency on load current. Preferably, the low-dropout linear regulator of the present invention includes an error amplifier which includes a cascaded arrangement of a differential amplifier and a gain stage. The gain stage includes a transistor driven by the differential amplifier to produce at a drive signal for an output stage of the regulator. The transistor is interposed over its source-drain line between a first resistive load included in a RC network creating a zero in the open loop gain of the regulator, and a second resistive load to produce a drive signal for the output stage of the regulator. The second resistive load is a non-linear compensation element to render current consumption linearly proportional to the load current to the regulator. Similarly, the first resistive load is a non-linear element causing the frequency of said zero created by the RC network to decrease as the load current of the regulator decreases.

BRIEF DESCRIPTION OF THE DRAWINGS

The invention will now be described, by way of example only, with reference to the enclosed views, wherein.

DETAILED DESCRIPTION OF PREFERRED EMBODIMENTS

In the following description, numerous specific details are given to provide a thorough understanding of embodiments. The embodiments can be practiced without one or more of the specific details, or with other methods, components, materials, etc. In other instances, well-known structures, materials, or operations are not shown or described in detail to avoid obscuring aspects of the embodiments.

Reference throughout this specification to "one embodiment" or "an embodiment" means that a particular feature, structure, or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

The headings provided herein are for convenience only and do not interpret the scope or meaning of the embodiments.

Figure 1:
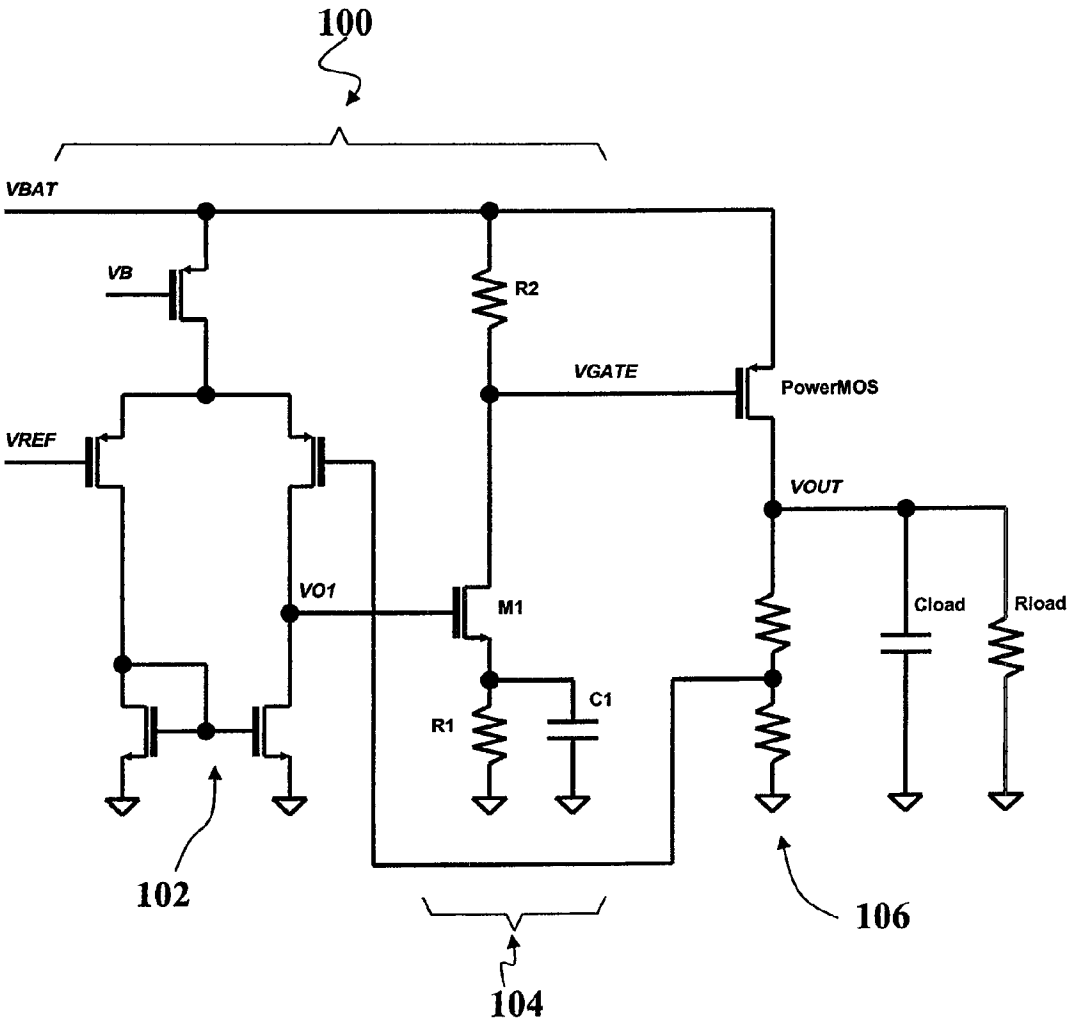
Fig. 1 PRIOR ART
FIG. 1 is exemplary of the circuit layout of a conventional low-dropout linear regulator.

The embodiment described herein is a proposed modification of the general layout of an LDO as illustrated in FIG. 1. Consequently, the detailed description of the embodiment described herein will not repeat those elements that are common with the arrangement of FIG. 1.

It will be otherwise understood that components/elements that are identical or equivalent are indicated with the same references throughout the views annexed herein.

Also, it will be appreciated that the embodiment described herein is applicable to any LDO layout including an error amplifier including a cascaded arrangement of a differential amplifier and an output gain stage, irrespective of the constructional details of these amplifiers or stages. Referring to the constructional details of the LDO layout of FIG. 1 is thus merely for exemplary, non-limiting purposes.

Figure 3:
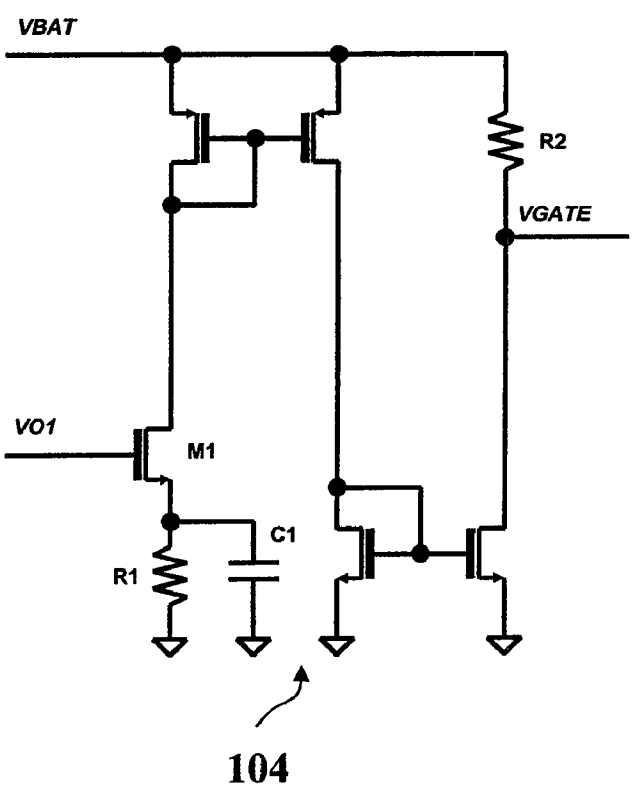
Fig. 3 PRIOR ART
FIG. 3 illustrates another conventional embodiment of the gain stage of FIG. 1.
Figure 2:
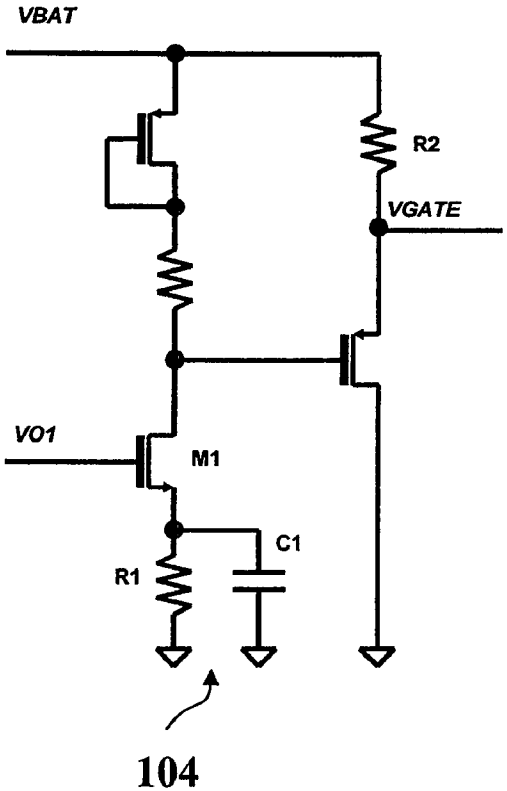
Fig. 2 PRIOR ART
FIG. 2 illustrates a conventional embodiment of the gain stage of FIG. 1.
Figure 4:
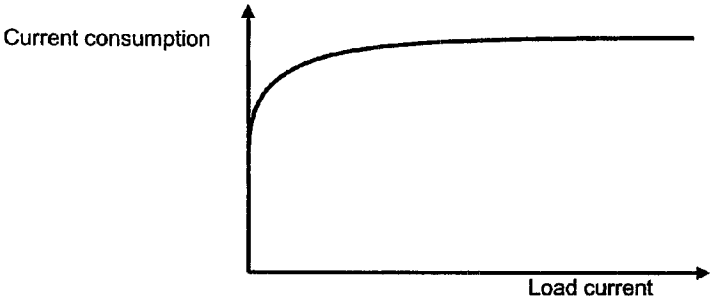
Fig. 4 PRIOR ART
FIG. 4 shows a typical current consumption versus load current profile of an LDO.
Figure 5:
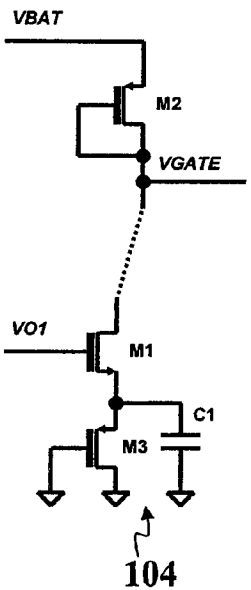
FIG. 5 is representative of a possible embodiment of the arrangement described herein.

The embodiment illustrated in FIG. 5 involves substituting for the resistor R2 in the stage 104 of FIG. 1 (or the resistor R2 in the stage 104 of either of FIGS. 2 and 3) a transistor (e.g. a MOSFET) M2 connected as a diode. As indicated in the introductory portion of this description, this diode constitutes a non-linear element able to compensate the non-linearity of output power MOS in that a linear current mirror is created. By adopting this approach, current consumption is made exactly linearly proportional to the load current.

As indicated, this step alone causes the second pole of the open loop gain of the LDO is displaced towards lower frequencies, thus adversely affecting LDO stability.

The embodiment of FIG. 5 compensates the displacement of that second pole (and the ensuing decrease in the phase margin) by replacing also the resistor R1 at the source of the MOSFET M1 by means of a transistor (e.g. a MOSFET) M3 connected as a diode. The frequency of the positive zero created by the RC network at the source of the MOSFET M1 thus decreases as the load current decreases, thus achieving the desired compensation effect. Current consumption is thus made linearly proportional to the load current without however adversely affecting the phase margin, thus preserving LDO stability.

In the embodiment of FIG. 5, a higher input voltage to account for the threshold voltage of the transistor M3 (if the differential amplifier 102 is not dimensioned to provide sufficient output voltage) can be provided by means of a level shifter 105 arranged between the differential amplifier 102 and the stage 104.

Figure 6:
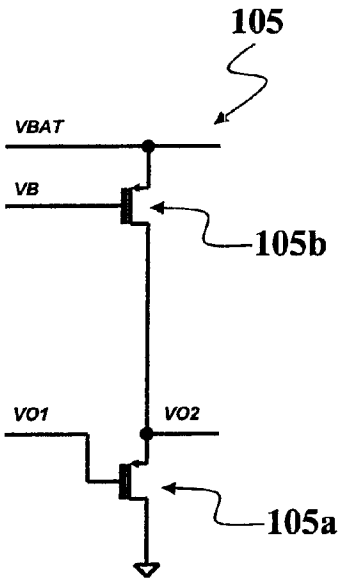
FIG. 6 illustrates details the embodiment of FIG. 5, and FIGS. 7 and 8 are detailed circuit diagrams of preferred embodiments of the present invention.

FIG. 6 illustrates a possible embodiment of such a level shifter 105, including a pair of MOSFETs 105*a*, 105*b* connected with their source-drain lines in parallel between the supply voltage VBAT and ground. The "low" MOSFET 105*a* receives the voltage VO1 from the output of the differential amplifier 102 and supplies a "stepped up" voltage VO2 to the stage 104. The bias current for the level shifter 105 (which may be adjusted via a signal VB at the gate of the "high" MOSFET 105*b*) was found not to be critical, 0.5 μA being acceptable for most applications.

Figure 7:
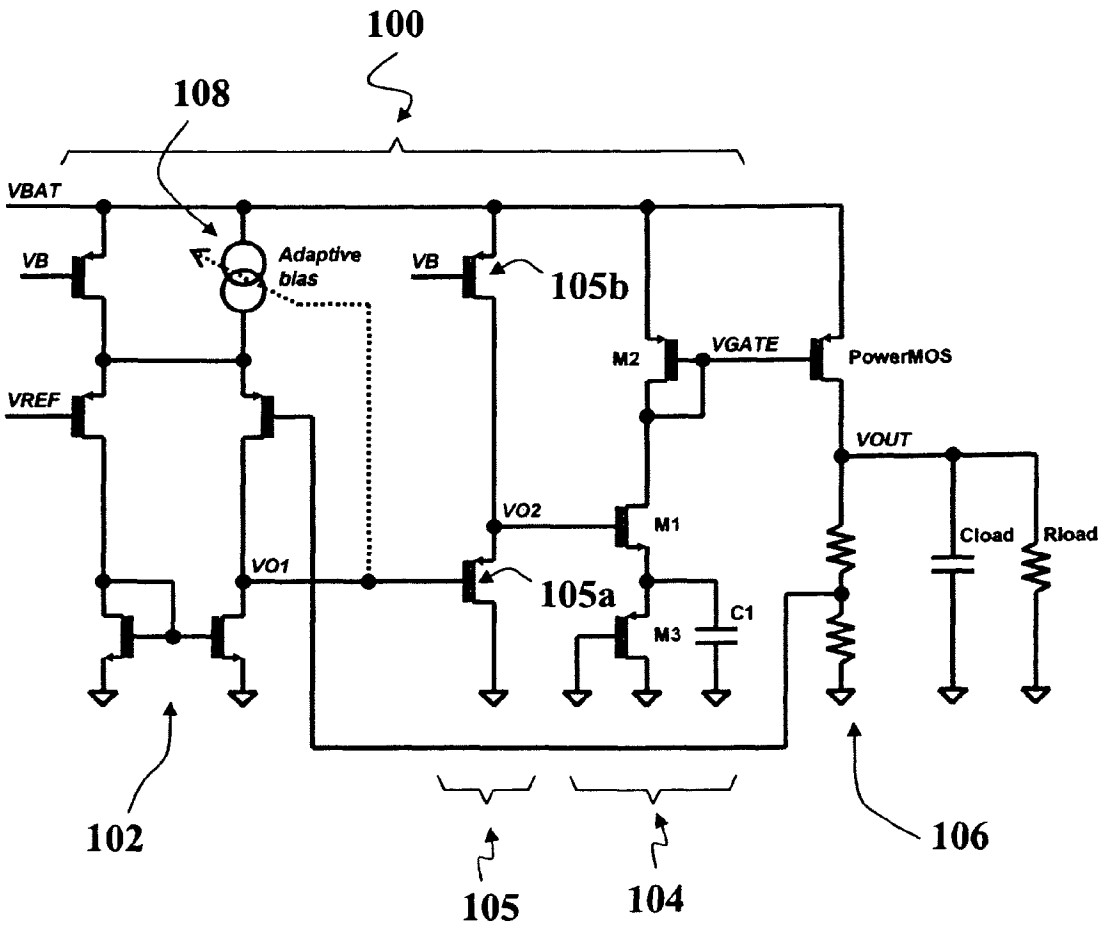

A whole schematic of the LDO of FIG. 1 as modified to incorporate the embodiments described, is illustrated in FIG. 7.

In an embodiment as exemplified, the LDO may use an adaptive bias 108 in the differential amplifier 102 in order to decrease quiescent current at low output currents and consequently improve efficiency for low load currents.

In certain conditions of use, the output current may be too low thus causing the open loop gain of the LDO becoming very high. Under these circumstances, stability may become critical.

This issue can be dealt with by arranging for the output stage 106 to be "split" into a small power section (SmallPowerMOS) and large power section (BigPowerMOS). The stage 104 is correspondingly modified to include two drivers 104' and 104" as detailed in FIG. 8. Again components/elements that are identical or equivalent to components already described are indicated with the same references.

At low output currents, the driver 104' and the small power MOS are active. The current through the MOSFET M21 (which plays the role of M1) is less than the current from M20 so that the driver 104" and the big power MOS are not active.

If the output current is increased above a given threshold, then the driver 104" starts to operate and the driver 104' is switched off by the MOSFET M24. This behaviour ensures that the big power MOS never drives a low current (except for zero current) and thus never endangers the stability.

Figure 8:
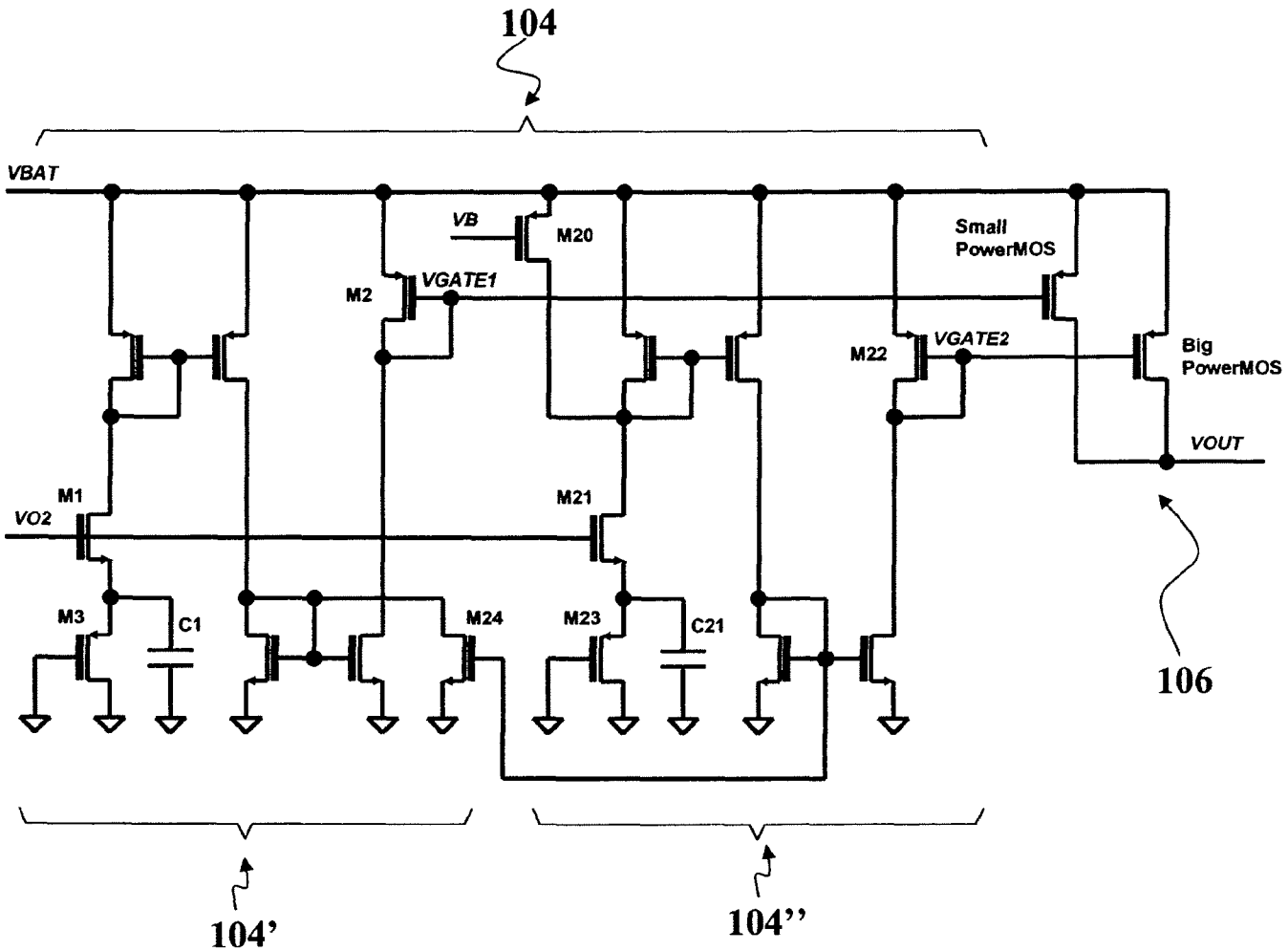

FIG. 8 shows that in each of the two drivers 104', 104":

- a transistor M1; M21 is provided, which is driven by the differential amplifier 102 to produce a respective drive signal VGATE1, VGATE2 for either of the small power section SmallPowerMOS and the large power section BigPowerMOS of the output stage 106 of the regulator,
- the transistor M1; M21 in question is interposed over its source-drain line between a first resistive load M3, M23 included in a RC network M3, C1; M23, C21 to create a zero in the open loop gain of the regulator, and a second resistive load M2; M22 to produce the respective drive signal VGATE1, VGATE2 for either of the small power section SmallPowerMOS and the large power section BigPowerMOS of the output stage 106 of the regulator,
- both the first resistive load M3; M23 and the second resistive load M2; M22 are non-linear compensation elements (e.g. transistors connected as diodes) to ensure—as better detailed in the foregoing—that current consumption is made linearly proportional to the load current to the regulator without adversely affecting regulator stability.

The embodiments described herein exhibit enhanced efficiency, especially for medium and lower load currents. This result is achieved by applying a strong linear current consumption dependency on load current.

Even if the instant detailed description and the preceding introductory portion make reference to circuitry including Field Effect Transistor o FETs (especially of the MOSFET type), the embodiments described herein lend themselves to be realized also by means of bipolar technology.

The designations "source", "gate" and "drain", as used herein and related to FET technology, are therefore to be understood as encompassing in all respects (including the claims) the designations "emitter", "base" e "collector" that indicate the homologous elements in a bipolar transistor. For instance, the term "source-drain line" is to be construed herein as encompassing the concept of "emitter-collector line").

Without prejudice to the underlying principles of the invention, the details and the embodiments may vary, even appreciably, with respect to what has been described by way of example only, without departing from the scope of the invention as defined by the annexed claims.

The invention claimed is:

1. A low-dropout linear regulator comprises:

an error amplifier including a cascaded arrangement of a differential amplifier and a gain stage, said gain stage including at least one transistor driven by said differential amplifier to produce at least one drive signal for an output stage of the regulator, wherein said at least one transistor is interposed over its source-drain line between at least one first resistive load included in a RC network creating a zero in the open loop gain of the regulator, and at least one second resistive load to produce at least one drive signal for an output stage of the regulator, wherein said at least one second resistive load is a non-linear compensation element to render current consumption linearly proportional to the load current to the regulator, and said at least one first resistive load is a non-linear element causing the frequency of said zero created by said RC network to decrease as the load current of the regulator decreases, and wherein said current consumption is made linearly proportional to the load current to the regulator without adversely affecting regulator stability.

2. The regulator of claim 1, wherein at least one of said non-linear resistive loads is a diode.

3. The regulator of claim 2, wherein at least one of said non-linear resistive loads is transistor connected as a diode.

4. The regulator of claim 3, further comprising:

a level shifter interposed between said differential amplifer and said gain stage to increase the level of the drive of said at least one transistor by said differential amplifier.

5. The regulator of claim 3, wherein said differential amplifier includes an adaptive bias to decrease the quiescent current at low output currents of the regulator.

6. The regulator of claim 3, wherein said output stage includes a small power section and a large power section, said gain stage includes two drivers selectively activatable to drive said small power section and said large power section, respectively, of said output stage, and wherein, in each of said two drivers, a transistor is provided driven by said differential amplifier to produce a respective drive signal for either of said small power section and said large power section of said output stage of the regulator, said transistor is interposed over its source-drain line between a first resistive load included in a RC network creating a zero in the open loop gain of the regulator, and a second resistive load to produce said respective drive signal for either of said small power section and said large power section of said output stage of the regulator, both said first resistive load and said second resistive load are a non-linear compensation elements whereby current consumption is made linearly proportional to the load current to the regulator without adversely affecting regulator stability.

7. The regulator of claim 2, further comprising:

a level shifter interposed between said differential amplifer and said gain stage to increase the level of the drive of said at least one transistor by said differential amplifier.

8. The regulator of claim 2, wherein said differential amplifier includes an adaptive bias to decrease the quiescent current at low output currents of the regulator.

9. The regulator of claim 2, wherein said output stage includes a small power section and a large power section, said gain stage includes two drivers selectively activatable to drive said small power section and said large power section, respectively, of said output stage, and wherein, in each of said two drivers, a transistor is provided driven by said differential amplifier to produce a respective drive signal for either of said small power section and said large power section of said output stage of the regulator, said transistor is interposed over its source-drain line between a first resistive load included in a RC network creating a zero in the open loop gain of the regulator, and a second resistive load to produce said respective drive signal for either of said small power section and said large power section of said output stage of the regulator, both said first resistive load and said second resistive load are a non-linear compensation elements whereby current consumption is made linearly proportional to the load current to the regulator without adversely affecting regulator stability.

10. The regulator of claim 1, further comprising:

a level shifter interposed between said differential amplifer and said gain stage to increase the level of the drive of said at least one transistor by said differential amplifier.

11. The regulator of claim 1, wherein said differential amplifier includes an adaptive bias to decrease the quiescent current at low output currents of the regulator.

12. The regulator of claim 1, wherein said output stage includes a small power section and a large power section, said gain stage includes two drivers selectively activatable to drive said small power section and said large power section, respectively, of said output stage, and wherein, in each of said two drivers, a transistor is provided driven by said differential amplifier to produce a respective drive signal for either of said small power section and said large power section of said output stage of the regulator, said transistor is interposed over its source-drain line between a first resistive load included in a RC network creating a zero in the open loop gain of the regulator, and a second resistive load to produce said respective drive signal for either of said small power section and said large power section of said output stage of the regulator, both said first resistive load and said second resistive load are a non-linear compensation elements whereby current consumption is made linearly proportional to the load current to the regulator without adversely affecting regulator stability.

13. A method of operating a low-dropout linear regulator including an error amplifier including a cascaded arrangement of a differential amplifier and a gain stage, including driving at least one transistor in said gain stage by means of said differential amplifier to produce at least one drive signal for an output stage of the regulator, wherein said at least one transistor is interposed over its source-drain line between:

at least one first resistive load included in a RC network creating a zero in the open loop gain of the regulator, and at least one second resistive load to produce at least one drive signal for an output stage (106) of the regulator, wherein said at least one second (M2) resistive load is a non-linear compensation element to render current consumption linearly proportional to the load current to the regulator, the method including making also said at least one first resistive load a non-linear element causing and cause the frequency of said zero created by said RC network to decrease as the load current of the regulator decreases, whereby current consumption is made linearly proportional to the load current to the regulator without adversely affecting regulator stability.

* * * * *